US006032305A

United States Patent [19]

Tedrick

[11] Patent Number: 6,032,305

[45] Date of Patent: Mar. 7, 2000

[54] SPA COVER LIFTER

[76] Inventor: John Tedrick, 4937 S. 86 E. Ave., Tulsa, Okla. 74145

[21] Appl. No.: 09/299,286

[22] Filed: Apr. 26, 1999

Related U.S. Application Data

[63] Continuation-in-part of application No. 08/948,017, Oct. 10, 1997, abandoned.

[51] Int. Cl.[7] ..... E04H 4/00

[52] U.S. Cl. ..... 4/498; 4/580; 49/246; 220/817; 220/819; 220/827; 220/836

[58] Field of Search ..... 4/498, 500, 503, 4/580; 49/246; 160/210; 220/817, 819, 827, 836, 211

[56] References Cited

U.S. PATENT DOCUMENTS

| | | | |
|---|---|---|---|
| 683,816 | 10/1901 | Towers | 220/827 |
| 4,518,095 | 5/1985 | Engwert | 220/817 |
| 4,853,985 | 8/1989 | Perry | 4/498 |
| 4,991,238 | 2/1991 | Forrest | 4/498 |
| 5,048,153 | 9/1991 | Wall et al. | 4/498 |
| 5,131,102 | 7/1992 | Salley et al. | 4/498 |
| 5,634,218 | 6/1997 | Quelette | 4/498 |
| 5,689,841 | 11/1997 | Black et al. | 4/498 |

FOREIGN PATENT DOCUMENTS

| | | | |
|---|---|---|---|
| 1401078 A | 10/1968 | Germany | 49/246 |

*Primary Examiner*—Charles R. Eloshway

[57] ABSTRACT

A device for removing spa covers and storing them, while the spa is in use, and returning them to cover the spa after use. The device may be operated with very little effort on the part of the user to lift the cover up and "off" the spa and over the end for storage. The spring balance aids in returning the cover to the "on" position. This device also reduces the possibility of having the wind damage or blow away the spa cover. Handicapped persons may find the installation of the hand crank or electric motor provisions will help them remove and replace the cover.

3 Claims, 6 Drawing Sheets

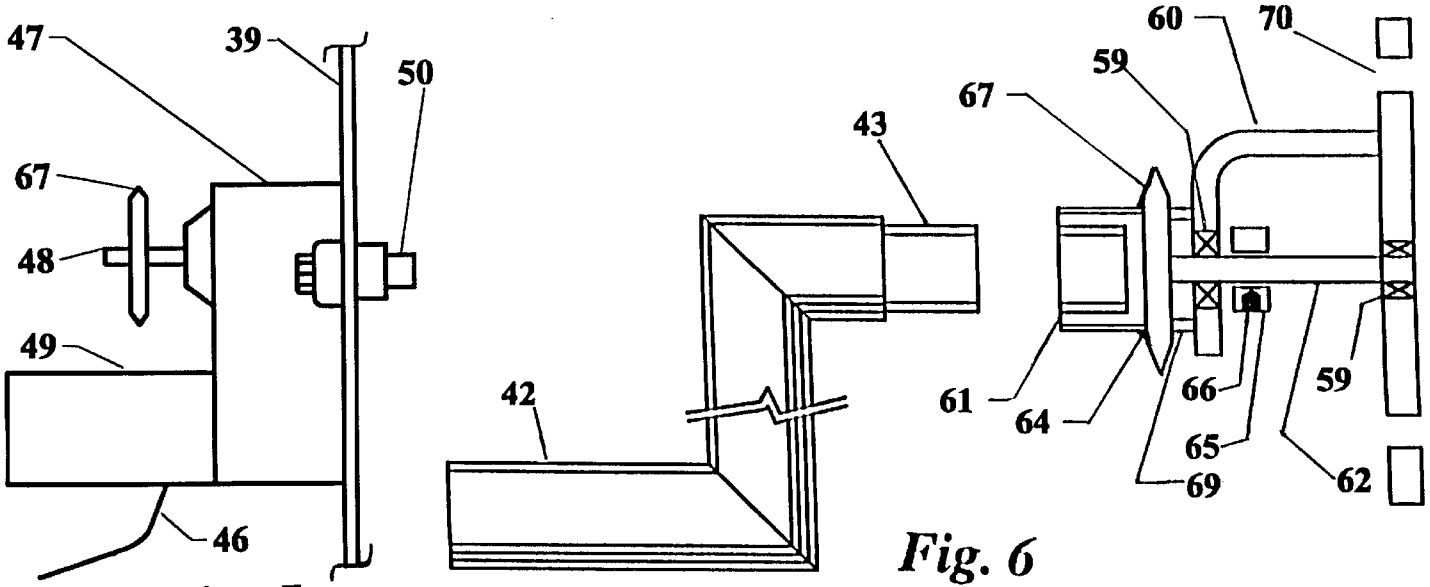
Fig. 5
Fig. 6
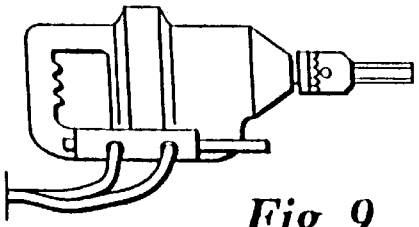
Fig. 9
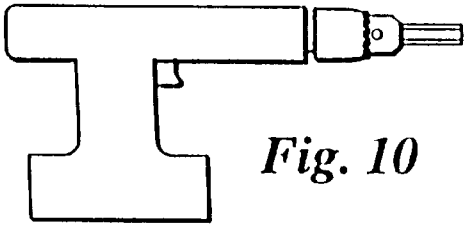
Fig. 10
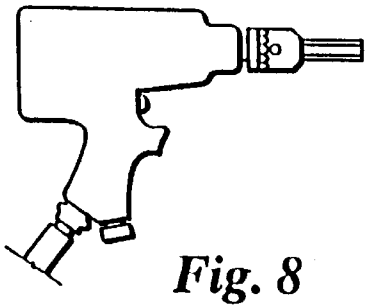
Fig. 8
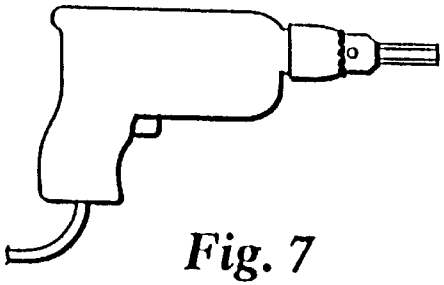
Fig. 7

SPA COVER LIFTER

This application is a continuation-in-part of application Ser. No. 08/948,017, filed Oct. 10, 1997, now abandoned.

BACKGROUND OF THE INVENTION

This invention relates to a lifting mechanism for removing and replacing the cover of a spa. The use of spas has become widespread, and most spas are equipped with covers which when closed prevents debris, rain and the like from contaminating the tub water. The cover further serves to retain heat within the tub. As a consequence, spa covers tend to be relatively heavy and difficult to remove and replace.

Lifting devices have been developed to aid in the removal and replacement of these relatively heavy spa covers. These devices can be operated with varying amounts of difficulty.

Some problems exist with past lifting mechanism designs. A unit with one lifting arm can produce excessive wear on the edge of the spa and the bottom of the spa cover when the cover is slid and pushed to the "off" position.

With only one lifting arm the spa cover tends to become angularity offset when the operator pulls or pushes on one side only. This can produce additional wear on the spa and spa cover. Some units require a chain or link to limit travel.

SUMMARY OF THE INVENTION

It is therefore an object of the present invention to improve the apparatus for removing and replacing relatively heavy spa covers.

A still further object of the present invention is to provide a lifting apparatus for a spa cover that provides sufficient mechanical advantage so that it can be easily operated by one person to remove and to replace a relatively heavy spa cover.

Another object of the present invention is to provide a lifting apparatus for a spa cover that provides minimal contact between the cover and the spa surfaces during removal and replacement operations.

An additional object of the present invention is to stow the cover at the low point travel of the near lift bar thus eliminating the need for excess travel chains or cables.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. (1) is one quarter elevated view of the spa cover on the spa in the "on" position.

Figure 1:
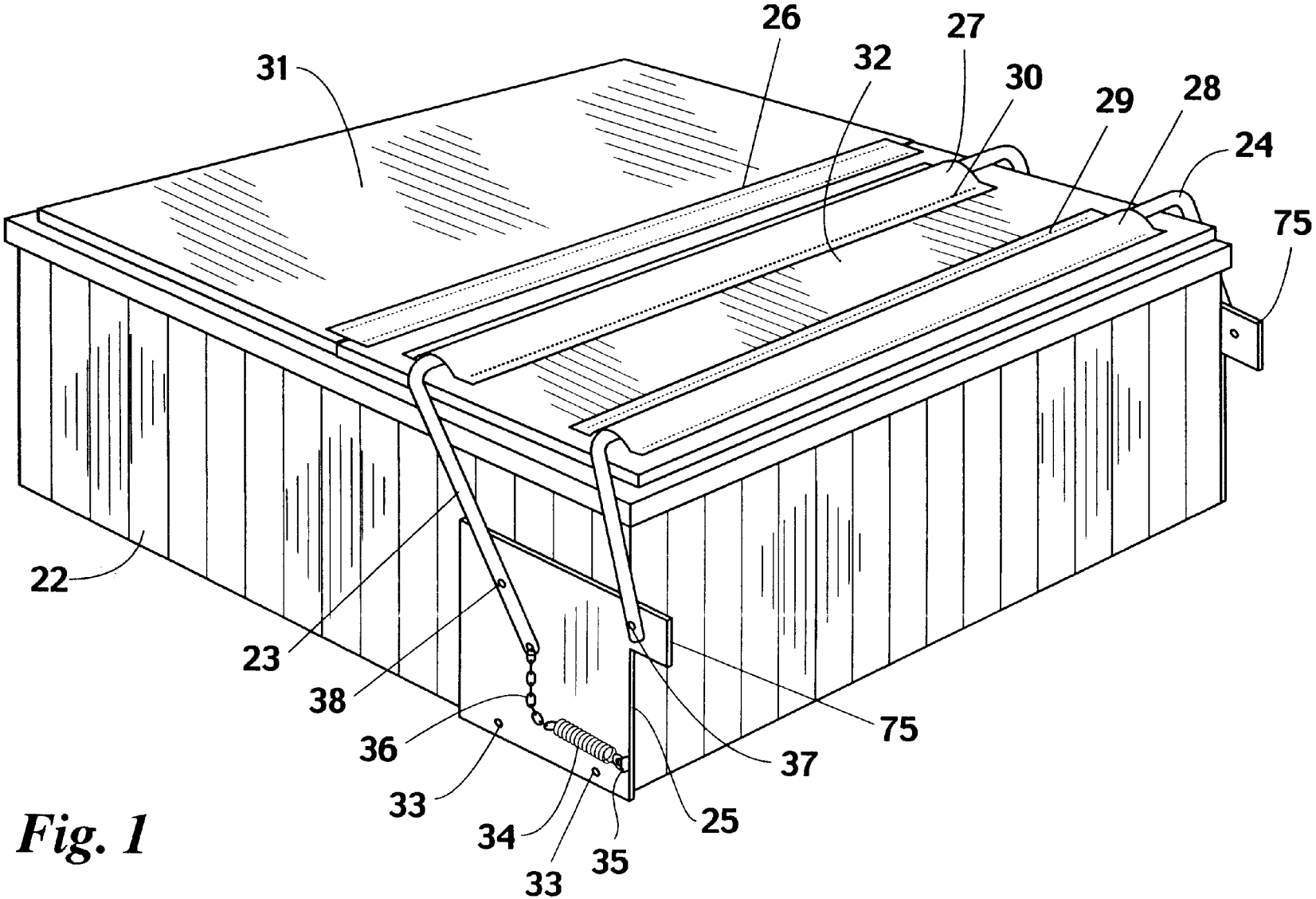
Figure 2:
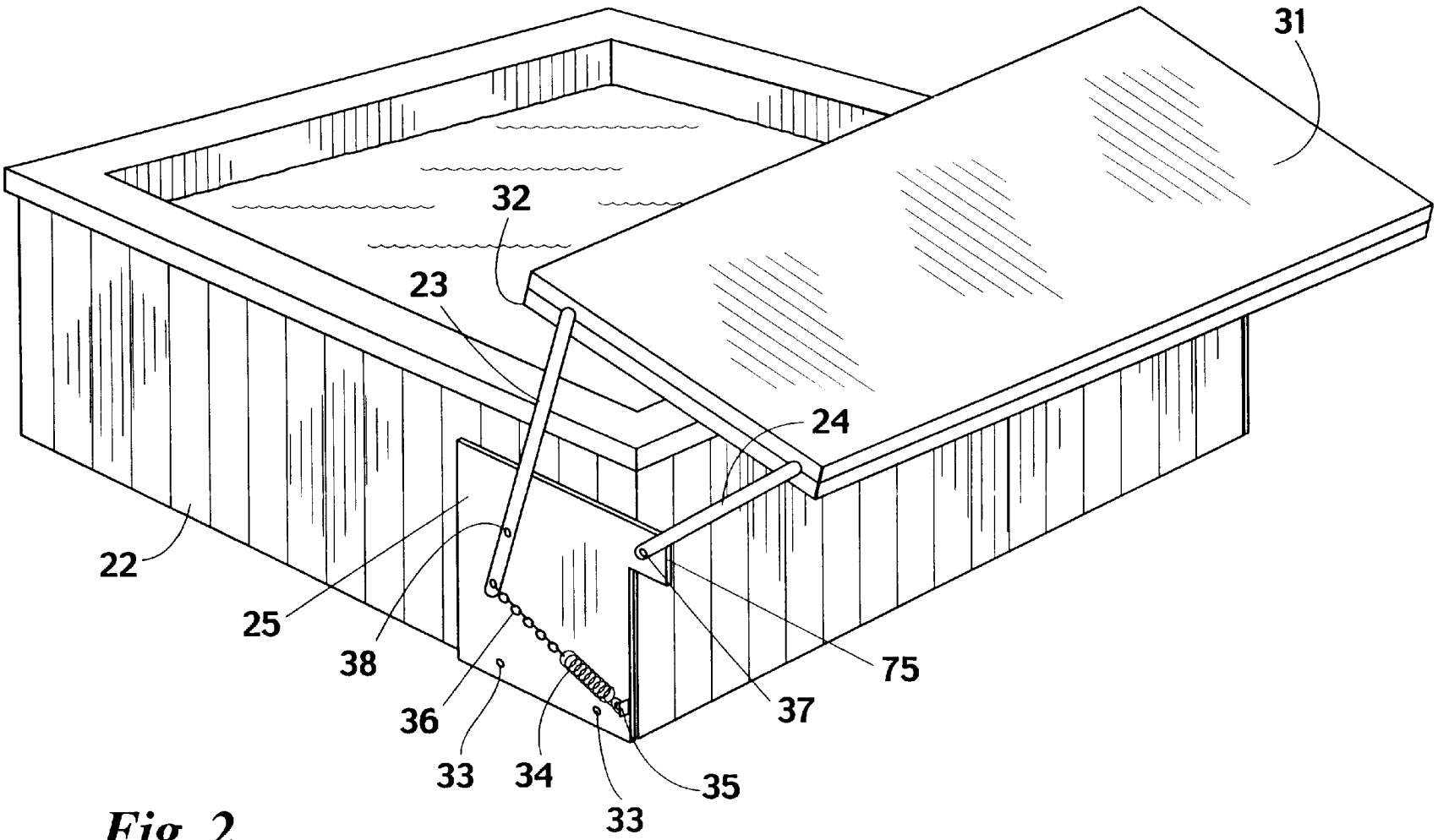
Figure 3:
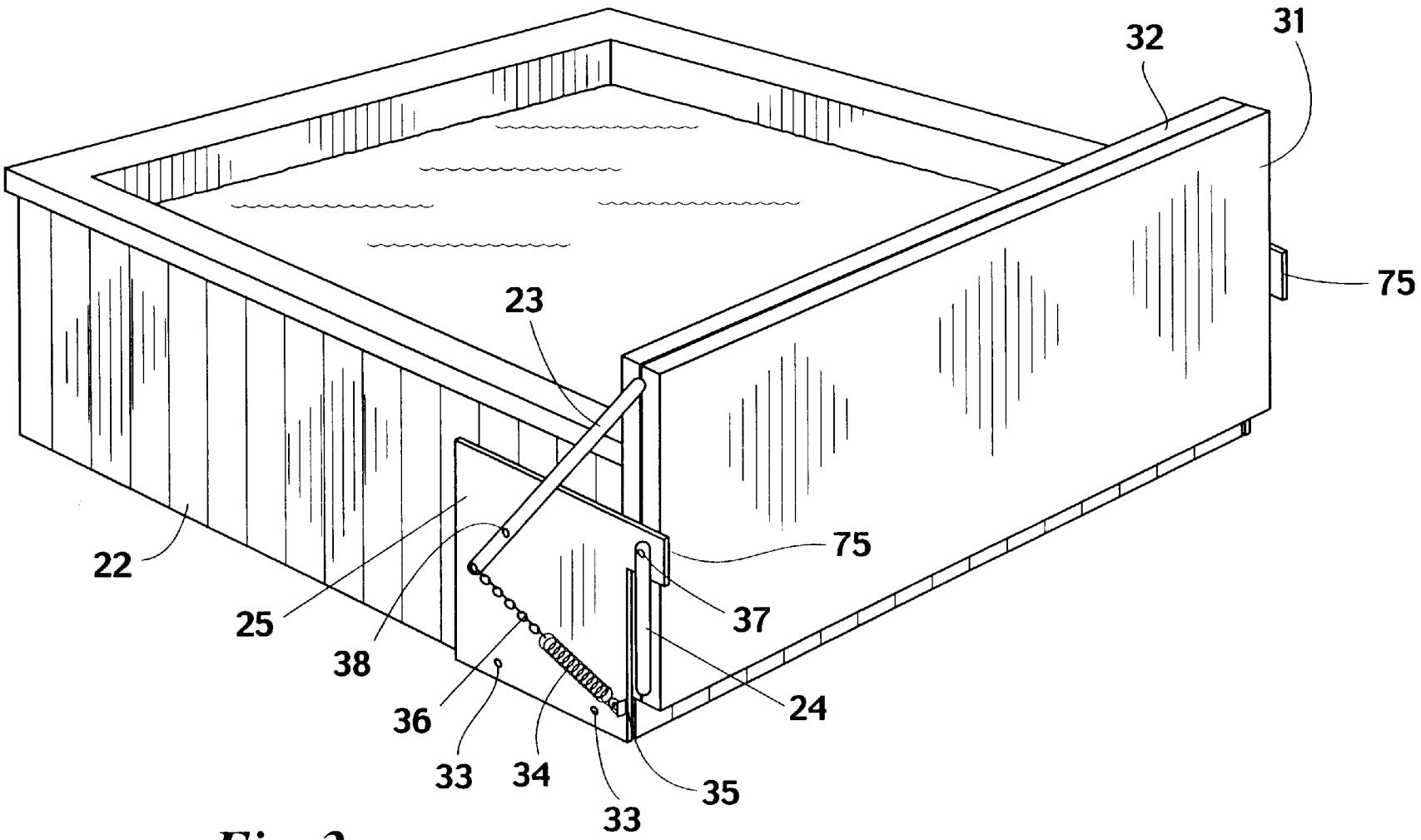

FIG. (2) is a one quarter elevated view of the spa cover in the "intransit" position.

FIG. (3) is a one quarter elevated view of the spa cover in the "off" position.

FIG. (4) is a side view showing the spa cover in the "folded on" position. Also shown is the chain drive lift mechanism.

FIG. (5) is a detail view of the gearbox, sprocket, and direct current motor.

FIG. (6) shows the socket shaft with sprocket and mounting provisions, a crank with hexagon drive bit, which may be inserted into the socket is also shown.

FIG. (7) shows a portable alternating current electric motor with gear reduction, switch, wiring, and hexagon bit which may be inserted to power the socket shaft.

FIG. (8) shows a portable air motor with gear reduction, valves and hexagon bit which may be inserted to power the socket shaft.

FIG. (9) shows a portable hydraulic motor with gear reduction, valves, and hexagon bit which may be inserted to power the socket shaft.

FIG. (10) shows a portable direct current electric motor with gear reduction, batteries, wiring, switch, and hexagon bit which may be inserted to power the socket shaft.

FIG. (11) shows a surface mounted gear box with direct current motor drive attached to the right side plate. A sprocket is attached to the output shaft and a chain is used to connect with the lift bar sprocket. A forward/off/reverse switch with wiring connects the battery to the motor.

INDEX OF REFERENCE NUMBERS

| | |
|---|---|
| 22. | Spa |
| 23. | Lift Bar, Center |
| 24. | Lift Bar, Near |
| 25. | Side Plate, Left |
| 26. | Flap, Cover Joining |
| 27. | Flap, Center Bar Retaining |
| 28. | Flap, End Bar Retaining |
| 29. | Zipper ® |
| 30. | Stitching |
| 31. | ½ Spa Cover, Far |
| 32. | ½ Spa Cover, Near |
| 33. | Screw Mounting |
| 34. | Spring |
| 35. | Spring Anchor |
| 36. | Chain |
| 37. | Pivot Bolt, End Bar |
| 38. | Pivot Bolt, Center Bar |
| 39. | Side Plate, Right |
| 42. | Crank |
| 43. | Hexagon Drive |
| 44. | Battery |
| 45. | Switch |
| 46. | Wiring |
| 47. | Gear Box |
| 48. | Shaft, Gear Box |
| 49. | Motor |
| 50. | Bolt |
| 59. | Bearing |
| 60. | Mount |
| 61. | Socket |
| 62. | Shaft, Sprocket Mount |
| 64. | Weld |
| 65. | Collar |
| 66. | Set Screw |
| 67. | Sprocket, Socket Drive |
| 69. | Spacer |
| 70. | Hole |
| 71. | Sprocket, Main Shaft |
| 72. | Roller Chain |
| 75. | Side Plate Extension |

DESCRIPTION OF THE INVENTION

FIG. (1) shows the lifting apparatus installed on a spa and spa cover. The cover is shown in the "on" position. The left side plate (25) is attached to the spa using bolts or screws. The right side plate is attached to the right side in a similar manner. The near lift bar is installed at the end of the spa using pivot bolts (37).

The center lift bar (23) is installed using pivot bolts (38). The center and near lift bars are attached to the near half of the cover (32) using flaps (27) and (28) and zippers® (29).

Counter balance springs, FIG. (1) reference (34), are installed on both sides of the spa. The dead end of the springs (34) are connected to the side plates (25) and (39).

The live ends are attached to the spacer chains (36), which in turn are connected to the lower ends of the center lift bar (23). In use, spring tension is not required in the initial removal movement of the cover, thus the lift bar (23) can travel a measured distance until all slack is taken out of the chains (36) and the springs (34) are beginning to stretch.

Figure 4:
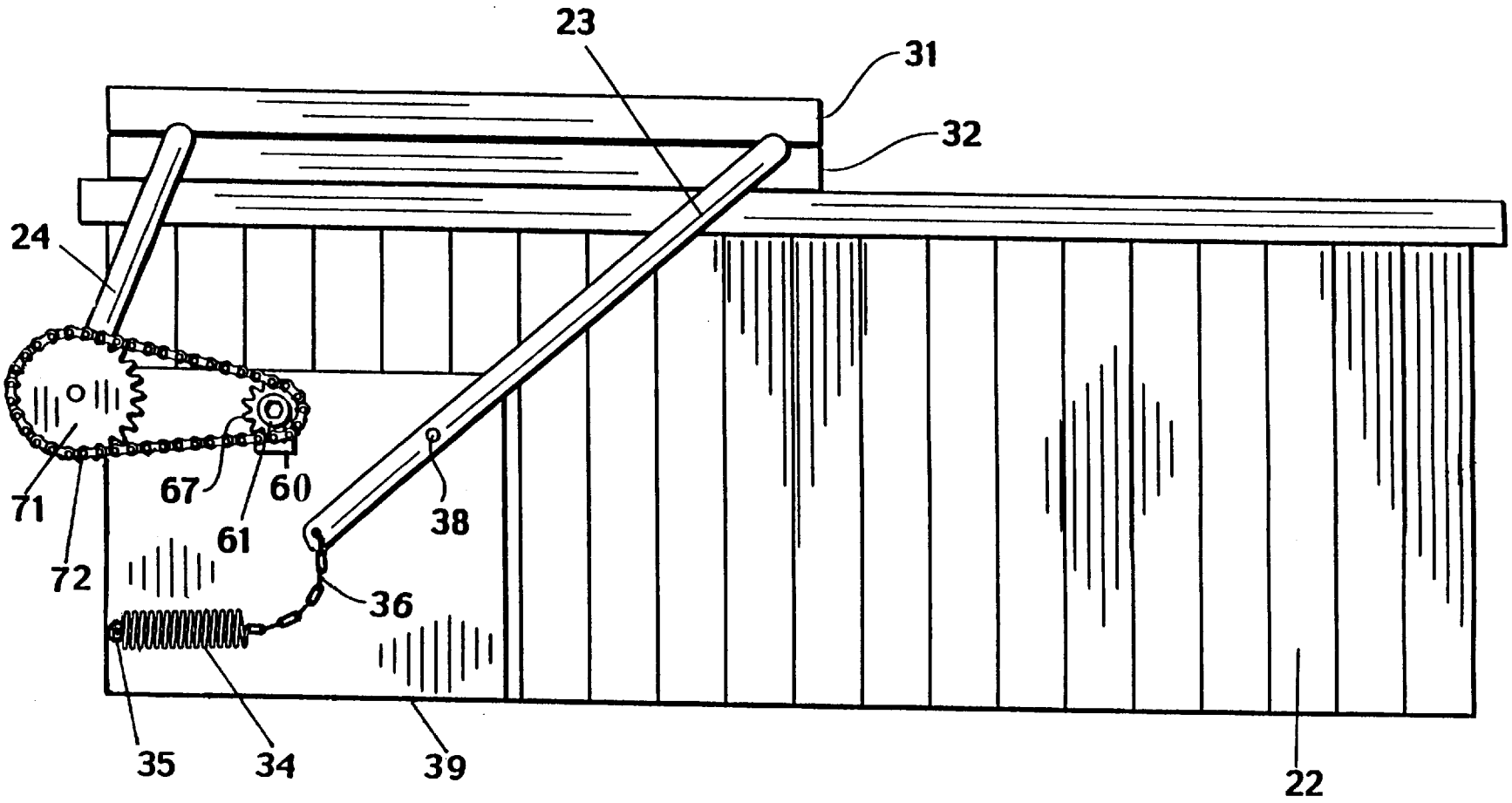
Figure 11:
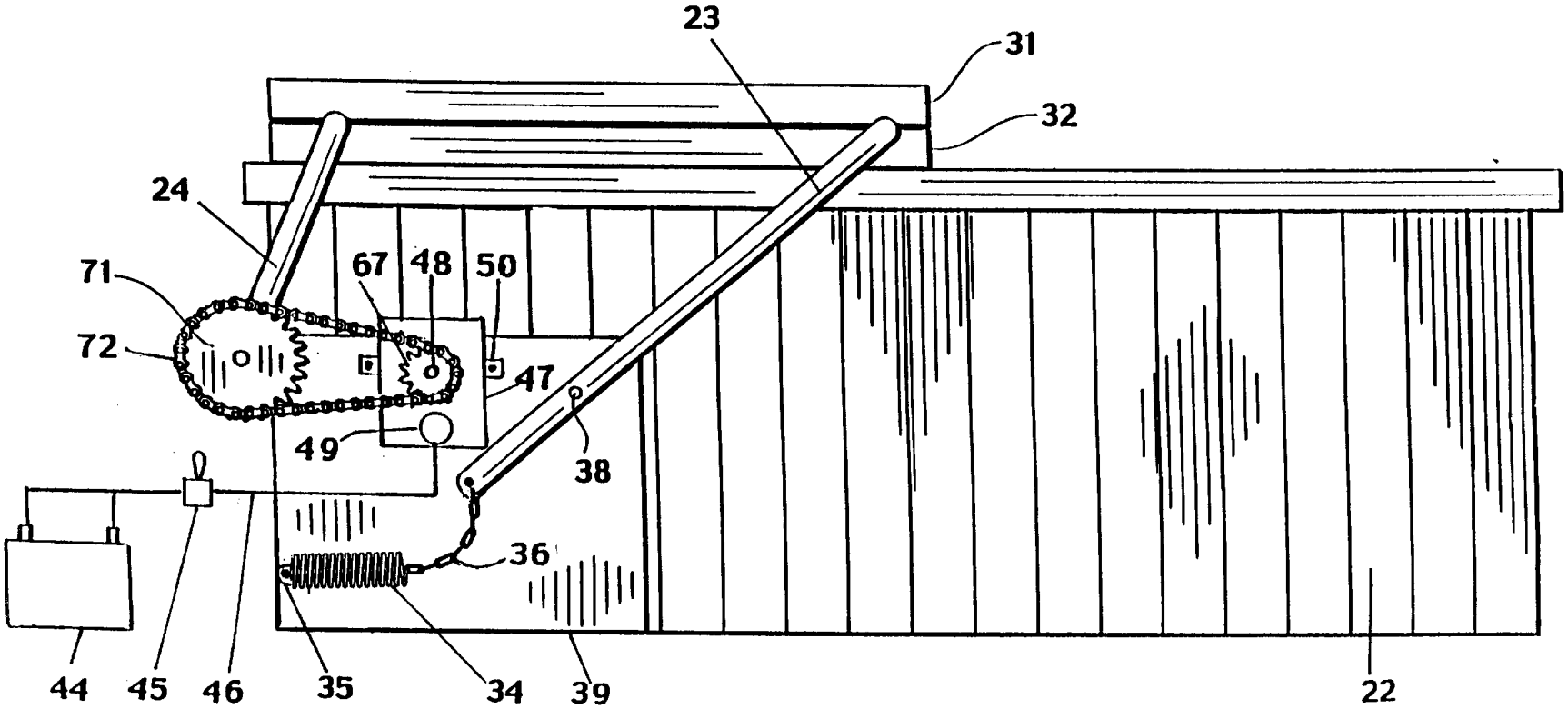

Using the flaps (27),(28) and zippers (29) shown in FIG. 4 the lift bars may be attached to the spa cover (32) without having to drill holes through the cover to install u-bolts or other mechanical fasteners.

FIG. (6) shows a crank (42) which can be inserted to drive the socket (61) and shaft (62) with sprocket (67) and roller chain (72) connecting the sprocket shaft with the large sprocket (71) on the near lift bar (24). Rotating the crank clockwise will move the spa cover to the "on" position. Rotating the crank counterclockwise will move the spa cover to the "off" position.

Alternate means of powering the socket shaft are provided as shown in FIGS. (7) through (10), which include an alternating current powered drill, an air powered drill, a hydraulic powered drill and a direct current battery powered drill.

FIG. (5) shows an alternate means for turning the sprocket (67). A motor (49) connected to a power source through wiring (46) is used to drive a gear box (47) which turns a shaft (48) connected to the sprocket (67). The turning of shaft (48) causes the sprocket (67) to move the chain drive (72) and crank (42) to move the cover. The gear box (47) is mounted on one of the plates (39) by a mounting bolt (50).

What is claimed is:

1. An apparatus for lifting a folding spa cover from a covering position over a spa to an uncovering position beside the spa and back, comprising:

a U-shaped center lift bar adapted to be pivotally attached to one of the folding sections of the cover;

a U-shaped near lift bar adapted to be pivotally attached to said one of the folding sections of the cover;

left and right mounting plates adapted for attachment to opposite sides of the spa, opposing legs of each bar being pivotally attached to a respective one of said plates;

left and right counterbalancing means connected respectively to said left and right mounting plates and to a respective leg of said center lift bar for counterbalancing the weight of the folded spa cover as it is moved from the uncovered to the covered position;

a crank connected to said near lift bar;

a sprocket rotatably mounted on one of said left and right plates;

a chain drive connecting said crank and said sprocket; and means for turning said sprocket, whereby turning said sprocket causes said chain drive to turn said crank, thereby pivoting said near lift bar, causing it to move the cover between the covered and uncovered positions.

2. The apparatus of claim 1, wherein said sprocket includes a socket and said means for turning is selected from the group consisting of alternating current-powered drills, direct current-powered drills, air-powered drills, and hydraulic-powered drills.

3. The apparatus of claim 1, wherein said means for turning comprises an electric motor-driven gear box operatively connected to the sprocket for turning the sprocket in response to operation of the motor.

* * * * *

UNITED STATES PATENT AND TRADEMARK OFFICE

CERTIFICATE OF CORRECTION

PATENT NO. : 6,032,305
DATED : March 7, 2000
INVENTOR(S) : John Tedrick

It is certified that error appears in the above-identified patent and that said Letters Patent is hereby corrected as shown below:

Column 3,
Line 29, should be deleted and substitute therefor:

-- [72] to move the cover. The gear box 47 is --.

Column 4,
Lines 14-24 (claim 1, lines 17-25), should be deleted and substitute therefor:

-- a first sprocket connected to said near lift bar;
a second sprocket rotatably mounted on one of said left and right plates:
a chain drive connecting said first and second sprockets; and
means for turning said second sprocket, whereby
turning said second sprocket causes said chain drive to turn said first sprocket, thereby pivoting said near lift bar, causing it to move the cover between the covered and uncovered positions. --.

Column 4,
Line 24 (claim 2, line 1), should be deleted and substitute therefor:

-- 2. The apparatus of claim 1, wherein said second sprocket --.

Lines 30-32 (claim 3, lines 2-4), should be deleted and substitute therefor:

-- turning comprises an electric motor-driven gear box operatively connected to the chain drive for turning the first sprocket in response to operation of the motor. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*